United States Patent [19]

Grise

[11] Patent Number: 4,626,664

[45] Date of Patent: Dec. 2, 1986

[54] ELECTRICAL HEATING DEVICE

[75] Inventor: Frederick G. J. Grise, Osterville, Mass.

[73] Assignee: Flexwatt Corporation, Canton, Mass.

[21] Appl. No.: 654,772

[22] Filed: Sep. 26, 1984

Related U.S. Application Data

[63] Continuation-in-part of Ser. No. 580,472, Feb. 15, 1984.

[51] Int. Cl.[4] ..... H05B 3/06; H05B 3/54

[52] U.S. Cl. ..... 219/525; 219/464; 219/543; 219/544; 219/549; 338/211

[58] Field of Search ..... 219/203, 211, 212, 217, 219/345, 464, 522, 528, 535, 539, 541, 543, 544, 553, 525, 542, 549; 338/22 R, 22 SD, 211, 212, 217

[56] References Cited

U.S. PATENT DOCUMENTS

| | | | |
|---|---|---|---|
| 2,179,819 | 11/1939 | Hoving | 219/535 X |
| 2,473,183 | 6/1949 | Watson | 219/549 X |
| 2,489,643 | 11/1949 | Hunter | 219/528 X |
| 3,387,248 | 6/1968 | Rees | 338/211 |
| 3,558,858 | 1/1971 | Luger | 219/528 |
| 3,757,086 | 9/1973 | Indoe | 219/528 |
| 3,852,570 | 12/1974 | Tyler | 219/528 |
| 4,002,883 | 1/1977 | Hurko | 219/543 |
| 4,307,290 | 12/1981 | Bloore et al. | 219/528 |
| 4,348,584 | 9/1982 | Gale et al. | 219/549 |
| 4,385,226 | 5/1983 | Sauer | 219/522 |

*Primary Examiner*—E. A. Goldberg
*Assistant Examiner*—Gerald E. Preston

[57] ABSTRACT

An electrical heating device comprising a substrate having an upper insulating surface, a semi-conductor pattern carried on the insulating surface, and a pair of metallic conductors mounted in face-to-face engagement with said semi-conductor pattern. The semi-conductor pattern includes a pair of spaced connector portions and at least one heating portion extending between and electrically connected to each of said connector portions, the connector portions have a electrical conductivity greater than that of said heating portion, and each of the metallic conductors is in face-to-face engagement with a respective one of said connector portions and has an area that is less than that of said respective one of said connector portions and an area:perimeter ratio greater than D/20 wherein D is the major dimension of the respective conductor portion.

16 Claims, 2 Drawing Figures

ELECTRICAL HEATING DEVICE

This invention relates to electrical heating devices. This application is a continuation-in-part of U.S. application Ser. No. 580,472 , filed Feb. 15, 1984.

BACKGROUND OF INVENTION

U.S. patent applications Ser. No. 181,974, filed Aug. 28, 1980 and now abandoned, Ser. No. 295,400, filed Aug. 21, 1981, Ser. No. 478,080 filed Mar. 23, 1983, and Ser. No. 572,678, filed Jan. 20, 1984, all of which, together with Ser. No. 580,742, are owned by the assignee of the present application and are here incorporated by reference, disclose flexible sheet heaters including a pair of longitudinally-extending (typically copper) conductors, and a semi-conductor pattern extending between and electrically connected to the conductors. The heaters there disclosed provide generally superior performance and substantially even heat distribution, and are useful in a wide range of applications.

There are circumstances, however, when it is desirable to provide heating closer to the side edges of the heater than can be accomplished with the heater design shown in the aforementioned applications. It also may be desirable to provide a heater construction which, because it eliminates the need for long copper conductors, is less expensive than the heater design of the aforementioned applications.

SUMMARY OF INVENTION

The present invention provides an electrical sheet heater which, while retaining important advantages of the structure of the heaters described in the aforementioned applications, eliminates the need for long copper conductors, simplifies connection, and provides for heating to closely adjacent the heater side edges.

In general, I have discovered that an electrical heating device comprising a substrate having an upper insulating surface, a semi-conductor pattern carried on the insulating surface, and a pair of metallic conductors mounted in face-to-face engagement with said semi-conductor pattern may have the aforementioned advantages if the semi-conductor pattern includes a pair of spaced connector portions and at least one heating portion extending between and electrically connected to each of said connector portions, the connector portions have a electrical conductivity greater than that of said said heating portion, and each of the metallic conductors is in face-to-face engagement with a respective one of said connector portions and has an area that is less than that of said respective one of said connector portions and an area:perimeter ratio greater than D/20 wherein D is the major dimension of the respective conductor portion.

In preferred embodiments in which an insulating layer overlies the substrate, semi-conductor pattern and metallic conductors, the connector portions similarly have an area:perimeter ratio greater than d/20 wherein d is the major dimension of the respective conductor portion (and preferably the connector portions of the semi-conductor pattern are nearly-square rectangles and the metallic conductors are circular), there are at least two heating portions having approximately the same watt density, each of which forms an at least 180° loop extending between said connector portions, each heating portion areas having different conductivities (ohms per square), and the minimum distance between the heating portions and the heater side edge is less than the width of the connecting portions.

DRAWINGS

DETAILED DESCRIPTION

Figure 1:
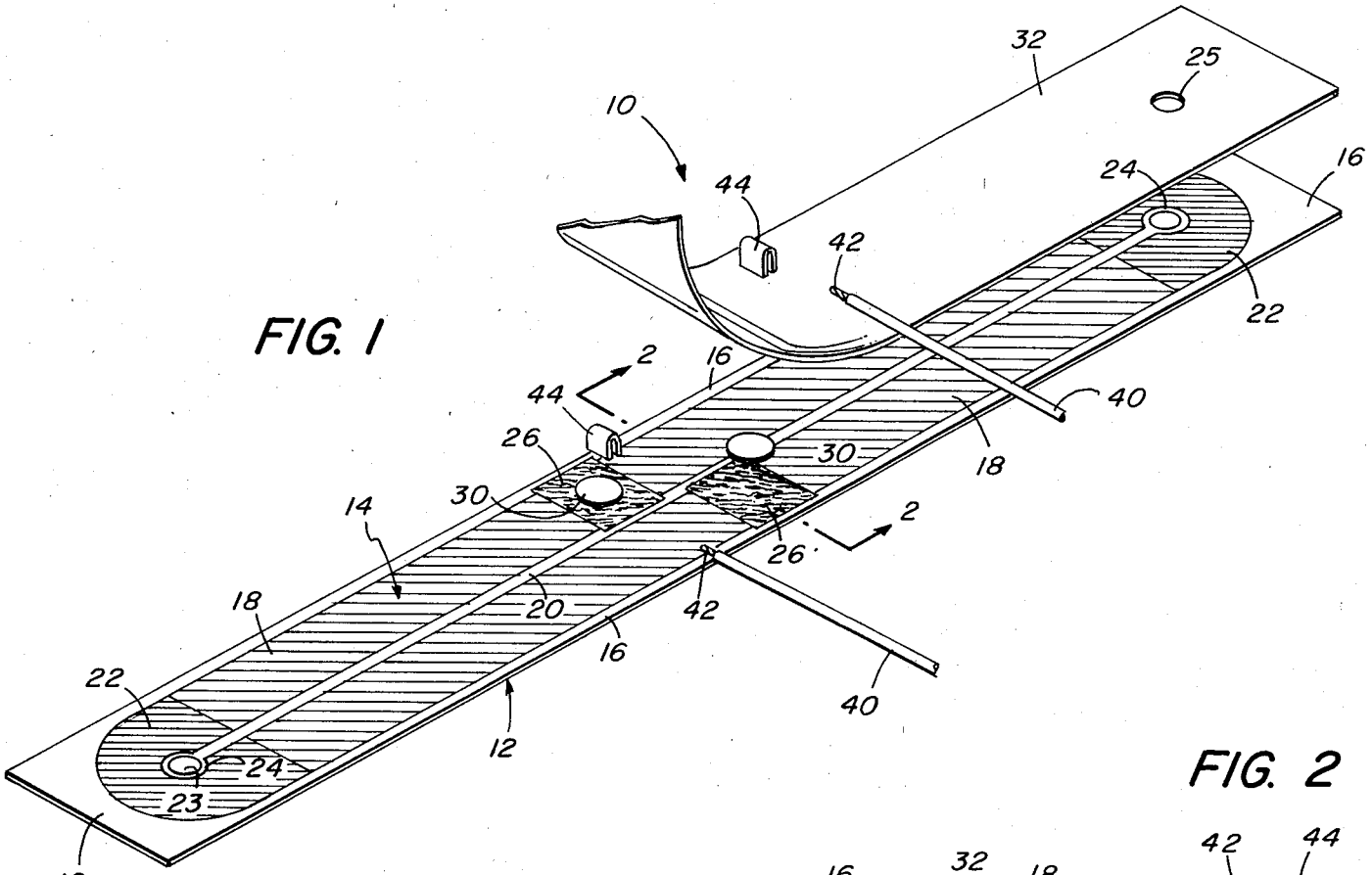
FIG. 1 is a perspective, exploded view, partially in section of a heater embodying the present invention.

Referring to the drawings, there is shown an electrical sheet heater, generally designated 10, designed for use at the mullion between the freezer and refrigeration compartments of a refrigerator, comprising a plastic substrate 12 on which is printed a semi-conductor pattern 14 of colloidal graphite. As shown, heater 10 is 2 inches wide and 30 inches long. Substrate 12 is 0.004 inch thick, essentially transparent, polyester ("Mylar").

The semi-conductor pattern 14 is centered on substrate 12, so as to provide an uncoated area 16 along the side edges and at each end. Along the edges, uncoated area 16 is approximately 3/16 inch wide; it has a minimum width of about ⅜ inch at each end.

As shown, pattern 14 includes a pair of parallel portions 18, each 27.00 inches long and 0.750 inches wide, with an uncoated space 20 (0.125 inch wide throughout most of its length) therebetween. Each parallel portion 18 extends substantially the full length of substrate 12. At the opposite ends of the substrate, the adjacent ends of portions 18 are connected by generally U-shaped end portions 22, each 1.125 inch long and 1.625 inch wide. As shown, the base of each end portion 22 is essentially semicircular, and the two legs of each "U" abut, and have the same width as, a respective one of parallel portions 18. A circular, 0.500 inch in diameter, uncoated space 24 is provided in each end portion 22, concentric with the semi-circular portion thereof.

Near the center of the heater 10, and on opposite sides of a transverse center line, a rectangular (and nearly square so that its area:perimeter ratio is greater than d/20 wherein d is the major dimension thereof and, preferably, is not significantly less than the d/4 ratio of a square or circle) connection portion 26 is centered on each parallel portion. Each connection portion 26 is about 0.750 inch long and 0.875 inch wide, and since it is centered on a respective parallel portion 18 extends about 0.0625 inch beyond each side thereof. As will be evident, the inner longitudinally-extending edges of the two connection portions 26 are aligned, but the adjacent transverse edges of the two connection portions 26 are spaced about 0.250 inch from each other. Because the connection portions are compact and do not extend any significant distance longitudinally or transversely of the heater 10, the heating portions of the semi-conductor pattern (e.g., the parallel portions 18 and end portions 26) may extend to very closely adjacent the heater side edges.

Connection portions 26 have a reater conductivity than do either parallel portions 18 or end portions 22 and, in the illustrated embodiment, parallel portions 18 are more conductive than the end portions. In the illustrated embodiment in which the pattern 14 is printed onto substrate 12 in three sequential printing steps, end portions 22 are printed one layer (e.g., about ½ to 1 mil) thick, parallel portions 18 are printed two layers thick, and connection portions 26 are printed three layers thick. All three portions are printed with a conductive ink having a resistance of about 100 ohms per square when printed at ½ mil thickness.

It will be noted that the semi-conductor pattern 14 of the illustrated embodiment provides two essentially identical current paths between connector portions, and that the two paths have the same watt density.

A tin-plated copper disc 30, 0.002 inch thich and 0.500 inch in diameter, is placed in the center of each connector portion.

A thin plastic cover sheet 32, comprising an essentially transparent co-lamination of an 0.005 cm. (0.002 in.) thick polyester ("Mylar") and an 0.007 cm (0.003 in.) thick adhesive binder, e.g., polyethylene, overlies substrate 12, semi-conductor pattern 14 and discs 30. As indicated, a ⅜ inch diameter hole 25 is punched through the heater at each end thereof, concentric with the circular unprinted area 24 in each end portion 24, to receive a screw or the like when the heater 10 is installed. Since the diameter of hole 25 is less than that of unprinted area 24, an unprinted annular area remains surrounding each hole.

Typically, discs 30 are not themselves bonded to the underlying semi-conductor material, and the cover sheet 32 bonds poorly to the semi-conductor pattern. However, the polyethylene forming the bottom layer of cover sheet 32 bonds well to substrate 12. Thus, when the cover sheet and substrate are laminated together (as taught in Ser. No. 572,578), the polyethylene bottom layer of cover sheet 32 bonds the cover sheet tightly the longitudinally-extending, uncoated (with semi-conductor material) areas 16 of substrate 12 between the outer periphery of the semi-conductor pattern 14 and the adjacent outside edge of the substrate 12, and along the uncoated (with semi-conductor material) are 20 between parallel semi-conductor pattern portions 18, and to the uncoated annular area surrounding each hole 25. Because the substrate 12 and cover sheet 32 are sealed tightly to each other in the areas 16 between the outside edge of pattern 14 and the outer edges of the heater, the unit is essentially heremetically sealed.

Figure 2:
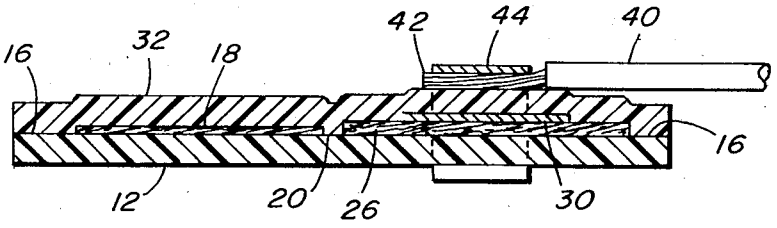
FIG. 2 is a sectional view, taken at 2—2 of FIG. 1 but not exploded, of the heater of FIG. 1.

For connecting the heater to a source of power (not shown and for the heater of the illustrated embodiment a conventional 120 volt a.c. source), a wire 40 is connected to each of discs 30. As shown most clearly in FIG. 2, the wire connection is made by centering the stripped end 42 of each wire over a respective disc, and then driving a copper staple 44 over the stripped end 42 of each wire through the entire thickness of the heater, including the respective disc 30. The staples 44 thus provide good electrical connection between discs 30 and wires 30, and also assist in holding the discs 30 tightly against the underlying semi-conductor pattern connection portions 26. In the preferred practice of the invention, the stapling is accomplished using an Autosplice brand connecting system, provided by the Autosplice division of General Staple Co., Woodside, N.Y. In some circumstances it may be desirable to drive the staples in the opposite direction from that shown, crimping the ends of the staples over the stripped end 42 of wire 40.

OTHER EMBODIMENTS

In other embodiments, connection portions 22 and discs 30 may be circular, oblong, square or rectangular, so long as the area:perimeter ratio of the discs (and generally of the connection portions also) is sufficiently great. Similarly, the shape of the heating (e.g., parallel and end) portions of the semi-conductor pattern may vary, as may the number of heating portions that extend between the connection portions. Generally, the watt density of each heating portion will be the same.

These and still other embodiments will be within the scope of the following claims.

What is claimed is:

1. In an electrical heating device comprising a generally flat substrate having an upper insulating surface, a semi-conductor pattern carried by said upper surface of said substrate, and a pair of generally flat metallic conductors mounted in a face-to-face engagement with said semi-conductor pattern, that improvement wherein:

said semi-conductor pattern includes a pair of spaced connector portions and at least one heating portion extending between and electrically connected to each of said connector portions;

said connector portions have an electrical conductivity greater than that of said said heating portion; and, each of said metallic conductors is in face-to-face engagement with a respective one of said connector portions, and the surface thereof in such engagement has an area that is less than the area of the upper surface of said respective one of said connector portions, the area:perimeter ratio of said surface of said conductor being about D/4 wherein D is the major dimension of said area of said conductor.

2. The heating device of claim 1 wherein an insulating layer overlyies said semi-conductor pattern and said conductors and sealing engages portions of said substrate that are free from said semi-conductor pattern.

3. The heating device of claim 1 including a wire electrically connected to each of said conductors, each such electrical connection being made by a connector engaging said wire and extending through a respective conductor.

4. The heating device of claim 1 wherein said heating portion includes areas having different conductivities (ohms per square).

5. The heating device of claim 1 wherein the minimum distance from said heating portion to a side edge of said heater is less than the width of either of said connection portions.

6. The heating device of claim 1 wherein said heating portion extends from one of said connection portions through a loop of at least 180° to the other of said connection portions.

7. The heating device of claim 6 including two of said heating portions connected to generally opposite sides of said connection portions.

8. The heating device of claim 1 including two of said heating portions, each of said heating portions having substantially the same watt density.

9. The heating device of claim 1 wherein said heating portions are substantially identical and extend in generally opposite directions from said connection portions.

10. The heating device of claim 1 wherein each of said connecting portions are adjacent each other, and said heating portion extends from each of said connecting portions in a direction forming an angle of not less than about 90° with a line extending directly from one of said connecting portions to the other of said connecting portions.

11. The heating device of claim 10 including at least two of said heating portions.

12. In an electrical heating device comprising a generally flat substrate having an upper insulating surface, a semi-conductor pattern carried by said upper surface of said substrate, and a pair of metallic conductors mounted in face-to-face engagement with said semi-conductor pattern, that improvement wherein:

said semi-conductor pattern includes generally U-shaped heating portions extending in opposite directions from and electrically connected to each of said conductors; and each of said heating portions includes areas of different conductivities (ohms per square) connected electrically in series.

13. The heating device of claim 12 wherein each of heating portions includes a pair of parallel, spaced apart leg portions of a first conductivity and an intermediate portion of a second conductivity different from said first conductivity.

14. The heating device of claim 13 wherein said semi-conductor pattern includes a pair of spaced connector portions, each of said leg portions has one end thereof connected to a respective one of said connector portions, and the other end thereof connected to a said intermediate portion.

15. The heating device of claim 12 wherein said heating portions are substantially identical.

16. The heating device of claim 14 wherein said connecting portions are adjacent each other, and a said heating portion extends from each of said connecting portions in a direction forming an angle of not less than about 90° with a line extending directly from one of said connecting portions to the other of said connecting portions.

* * * * *